US006474040B1

(12) United States Patent
Ours et al.

(10) Patent No.: US 6,474,040 B1
(45) **Date of Patent: *Nov. 5, 2002**

(54) METHOD AND APPARATUS FOR PRODUCING LINED CARTONS HAVING POUR SPOUTS

(75) Inventors: David C. Ours, Marshall; David L. Bradley, Battle Creek, both of MI (US)

(73) Assignee: Michigan State University, East Lansing, MI (US)

( * ) Notice: Subject to any disclaimer, the term of this patent is extended or adjusted under 35 U.S.C. 154(b) by 15 days.

This patent is subject to a terminal disclaimer.

(21) Appl. No.: 09/697,004

(22) Filed: Oct. 26, 2000

(51) Int. Cl.[7] ..... B65B 61/20

(52) U.S. Cl. ..... 53/133.3; 53/281; 53/471; 229/117.3

(58) Field of Search ..... 53/133.2, 133.3, 53/133.4, 281, 471, 478; 229/117.35, 125.04, 125.09, 125.14, 125.15, 215, 217

(56) References Cited

U.S. PATENT DOCUMENTS 6,062,467 A * 5/2000 Ours et al. ..... 229/117.3
6,145,736 A * 11/2000 Ours et al. ..... 229/117.3
6,213,388 B1 * 4/2001 Ours et al. ..... 229/117.3

* cited by examiner

*Primary Examiner*—John Sipos
*Assistant Examiner*—Hemant M. Desai
(74) *Attorney, Agent, or Firm*—Howard & Howard

(57) ABSTRACT

A method and apparatus for bonding a filled and sealed liner to an interior wall of a carton. The carton having the filled liner therein is heated under vacuum such that the pressure difference between the atmosphere under vacuum and the filled liner allows the liner to expand and bond to an interior wall of the carton by means of an adhesive provided there between.

3 Claims, 12 Drawing Sheets

METHOD AND APPARATUS FOR PRODUCING LINED CARTONS HAVING POUR SPOUTS

This application is related to U.S. patent application Ser. No. 09/213,100, filed Dec. 17, 1998, now U.S. Pat. No. 6,213,388, which is a continuation-in-part of application Ser. No. 09/150,966 filed Sep. 10, 1998 now U.S. Pat. No. 6,145,736, which is a continuation-in-part of application Ser. No. 09/050,533 filed Mar. 30, 1998 now U.S. Pat. No. 6,062,467, which claims priority from Provisional application Ser. No. 60/069,859 filed Dec. 17, 1997, and a continuation in part of Ser. No. 09/326,844 filed Jun. 7, 1999; each of which are incorporated herein by reference.

BACKGROUND

This invention relates to the packaging of dry particulate foods such as ready-to-eat ("RTE") cereal. More specifically, this invention relates to an apparatus and processes for preparing lined cartons of the type known as a bag-in-a-box. The cartons are produced by beating a carton having a filled and sealed liner therein such that the liner expands to contact an interior wall of the carton and is adhered to the interior wall by an adhesive disposed there between. In a preferred embodiment, the carton has a reclosable dispensing means or pour spout which is connected to the liner or bag in such a way that a portion thereof is separated from the liner upon initial opening of the dispensing means to provide access to the contents of the carton.

The apparatus of the invention have an infeed airlock infeed section, a central sealing section under vacuum, and a discharge airlock section. Cartons having filled and sealed liners pass through each of these sections via a conveyor, and the bag is adhered to the carton interior in the central section. In operation, there are three cartons at different stations of the apparatus at any given time; a first carton in the discharge airlock station which is the finished carton, that is, the liner has already been sealed tot eh carton; a second in the central sealing section which is being processed to bond the liner to the carton, and a third in the infeed airlock station which is the "new" carton which will be passed to the central sealing section to bond the liner to the carton. These are numbered in accordance with the process flow direction of the apparatus.

The use of cartons with liner bags for dry particulate products such as RTE cereal is well known. Such cartons are usually formed from a blank of paperboard or similar material comprising sidewalls with top and bottom flaps. The liner is a plastic or coated paper bag which holds the particulate product. The liner can be filled and sealed before or after being placed inside an open carton, the flaps of which are then folded and sealed.

Access to the contents of such cartons involves breaking the seal between the top flaps of the carton and pulling open the sealed liner bag. Resealing is often difficult and incomplete leading to a loss of freshness of the product. RTE cereal, for example, has a low moisture content and readily absorbs moisture from the air leading to a loss of crispness.

Dispensing devices such as pour spouts have been proposed to control the discharge of particulate product and minimize exposure to the atmosphere. However, when a carton with a pour spout contains a filled and sealed liner bag, the bag must be manually torn or cut with a knife or scissors when the spout is first opened. This arrangement has several drawbacks not the least of which is manually cutting or tearing of the liner bag. Once opened, and as the contents are depleted, the liner bag and its contents slide and shift positions in the carton which can cause the opened portion of the liner to become misaligned with the pour spout opening thereby hindering dispensing of product from the carton. This also causes product to drop between the carton and the liner.

Bag in the box type cartons and lined cartons in general are prepared using a variety of methods. Vacuum and induction heating are typical steps in such processes. For example, U.S. Pat. No. 2,998,788 to Back et al. disclose applying pour spout to the interior of liner in empty container. The spout is sealed to the inside of liner via a heated anvil. U.S. Pat. No. 4,918,906 to Ako discloses a package making system wherein bags are assembled within cartons, and U.S. Pat. No. 5,031,380 to Ueda discloses a package assembly system which includes a first container forming unit having a jaw, which includes a high frequency coil serving as a heater. U.S. Pat. No. 3,338,020 to McGee discloses a process of lining a container with plastic using vacuum. U.S. Pat. No. 4,723,935 to Furukawa discloses the use of air streams (vacuum) to force a lining against the inside of a carton or box. U.S. Pat. No. 4,095,390 to Knudsen discloses a manufacturing system wherein lids are placed on containers and sealed thereto as the assembled units travel past an induction heating area. The induction coil generates eddy current heat in a metal foil layer in the lid and thus welds to the container.

U.S. Pat. No. Reissue 33,467 to Steck et al. describes a machine for assembling filled containers of polyfoil wherein sealing jaws include induction coils used to induce a current in the metallic layer of the polyfoil to seal the container. The patent also shows an apparatus to carry out this operation.

U.S. Pat. No. 4,846,774 to Bell discloses a lid for a container which consists of a rigid ring and a removable membrane. The membrane, which includes a thin layer of aluminum, is welded (using induction heating) to the ring. Bell also discloses an apparatus to assemble the ring and membrane.

The existing approaches are limited in that the resulting packages provide limited protection of the package contents product from ambient moisture.

SUMMARY OF THE INVENTION

The present invention is therefore directed towards apparatus and methods for producing improved bag-in-a-box cartons where the bag or liner is physically adhered to the interior wall or walls of a sealed carton without breaking the seal of the liner. Thus, the liner will be prevented from slipping to the bottom of the carton. In preferred embodiments, the liner is adhered to the interior of the carton in such a way so as to provide placement of a reclosable pour device which readily facilitates initial opening or piercing of the package, yet offers superior protection from ambient moisture.

More specifically, the present invention is related to an apparatus sealing a filled liner to the interior of a dispensing assembly located in an end wall of a sealed carton containing said filled liner without breaking the seal of the filled liner. The apparatus includes a central sealing section connected to a vacuum source and having means for sealing positioned therein to align with the end wall of the carton. Infeed airlock and discharge airlock communicate with the central sealing section, and a conveyor moves the sealed cartons from the infeed airlock through the central section in sealing contact with the end wall and into the discharge airlock while maintaining a vacuum atmosphere in said central section. Using this apparatus, the liner is sealed to the interior of said dispensing assembly without breaking the seal of said liner.

The infeed airlock and outfeed airlock include a top and bottom conveyor which are adjustable to the carton size. Typically the top belt is raised or lowered to accommodate the specific carton to be processed. The conveyors are of sufficient length to maintain control of several boxes at a given time. Cartons are kept in the infeed and outfeed airlocks to block the flow of air and to aid maintaining vacuum inside the central portion.

Sensors in the airlock sections detect the presence of a carton. Upstream of the airlock is an additional sensor which can determine of sufficient cartons are available to maintain a continuous flow. During a continuous run, there are three cartons in the apparatus at any given point in time, a finished carton in the discharge airlock section, a second in the central sealing section and a third in the infeed airlock section. A full stream of cartons assists the airlocks to maintain vacuum along the working zone. When an upstream sensor detects that no more cartons are available, the infeed airlock stops with several cartons in it such that the vacuum is maintained in the working zone and the outfeed airlock continues to cycle until the working zone is clear, which is determined by a sensor at the beginning of the outfeed airlock. At this time, the cartons stop in the outfeed airlock to maintain vacuum. When the upstream sensor determines that cartons are again present, the infeed airlock starts in synchronization with the flow of cartons such that a full load of cartons is maintained in the airlock. As cartons approach the exit end of the working zone as determined by a senors at the beginning of the exit airlock, the outfeed airlock starts in harmony with the flow of cartons such that the outfeed airlock is always full. This system of sensors and conveyors ensures that three cartons in various stages of completion are in the apparatus at any given time as described supra.

This sequence also helps to maintain a level vacuum in the working zone. In the working zone, an induction coil is provided which creates the electric field to heat necessary to develop the currents to heat the foil target in the package. Once the foil reaches the appropriate temperature, the force created by the vacuum inflates the bag inside the box which sets the seal between the liner and the fitting.

Preferably, spaced lateral conveyors contact opposite sides of the cartons and feed them in a downstream direction. The lateral conveyors are positioned at right angles to the horizontal conveyor belt form a tight fit with the cartons to maintain a vacuum in all three sections.

To prepare the cartons of the present invention, a sealed carton having a sealed filled liner bag contained therein is conveyed into the infeed airlock section and fed into the central sealing section via the conveyor. In the central sealing section, the liner is adhered to the dispensing assembly of the carton and/or an end wall of the carton by application of bonding energy, e.g., RF frequency or heat, to activate a hot melt adhesive or other activatable adhesive or bonding material. The central sealing section is maintained under vacuum, with a vacuum pump for example, such that the pressure inside the bag is greater than the pressure in the sealing chamber. The bag typically has "dead space" therein, that is, space filled with air rather than product, allowing the bag to expand outwardly and press against the interior of the carton and against the heated adhesive, causing the bag to bond to the interior wall of the carton and a pour spout that has been affixed to an interior wall of the container. The sealed, lined carton is removed from the apparatus by the conveyor and transported from the central sealing section through the discharge airlock, where the finished carton is then ready to be further processed for shipping.

In a preferred embodiment, the central sealing section includes a liner expansion area and a heating area, both of which are contained in the same housing. The carton will first pass through the expansion area to allow the bag to inflate under vacuum tight against the interior of the carton, particularly in areas or portions of the bag to be bonded to the carton. Once expanded, the carton adhesive is heated to an appropriate temperature such that the liner is adhered to the carton. The carton is then discharged through the airlock for further processing.

In the preceding embodiment, the adhesive is a heat-activated adhesive. In alternative embodiments, the adhesive may be activated by alternative physical means, e.g., by radiation of appropriate frequency. In such embodiments, a means for providing such radiation will replace the heat source of the heating zone, the controlling factor being appropriate bonding of the liner to the carton.

In other preferred embodiments, a shaking or bumpy conveyor is used to settle the contents of the liner before entering the infeed section.

Preferred cartons prepared with the apparatus described herein preferably have a reclosable pour device having a dispensing flap or pour spout which comes into contact with the filled, sealed liner when it is placed in the container such that the liner to the dispensing flap in such a way that the bag remains sealed, but upon initial opening of the flap, that portion of the liner bonded to the flap separates from the liner to provide access to the contents of the carton. Suitable cartons having pour spouts are disclosed in U.S. Ser. No. 09/213,100 filed Dec. 17, 1998.

It is preferred that the liner is bonded to the dispensing flap and to the area adjacent the periphery of the dispensing flap to maintain a tight seal upon closing of the flap. Moreover, the liner remains bonded at the bottom of the dispensing opening (i.e. along the pivot axis) to maintain alignment, and preferably the liner is also bonded such that it is congruous with the carton to the edges defining the pour opening to prevent product from falling between the bag and the box.

It is preferred to heat seal the liner to create a weakened tear line in the liner, but without breaking the seal of the liner, to facilitate initial opening of both the flap or pour spout and the liner. The tear lines are in the vicinity of and preferably congruous with the tear lines of the dispensing flap to facilitate opening and to maintain tight seal upon reclosure.

DESCRIPTION OF THE DRAWINGS

The present invention will be more fully understood from the following description and the accompanying drawings wherein.

DETAILED DESCRIPTION

According to the present invention, a portion of a filled and sealed liner is brought into contact with and bonded to the front panel of a pour spout or a flap mounted in a dispensing opening in a side panel or end wall of a carton or carton blank. A vacuum creates environmental conditions such that the bag is closely contacted with the dispensing flap or pour spout. An adhesive is provided between the liner and the dispensing flap or front panel of the pour spout to promote bonding.

Figure 13:
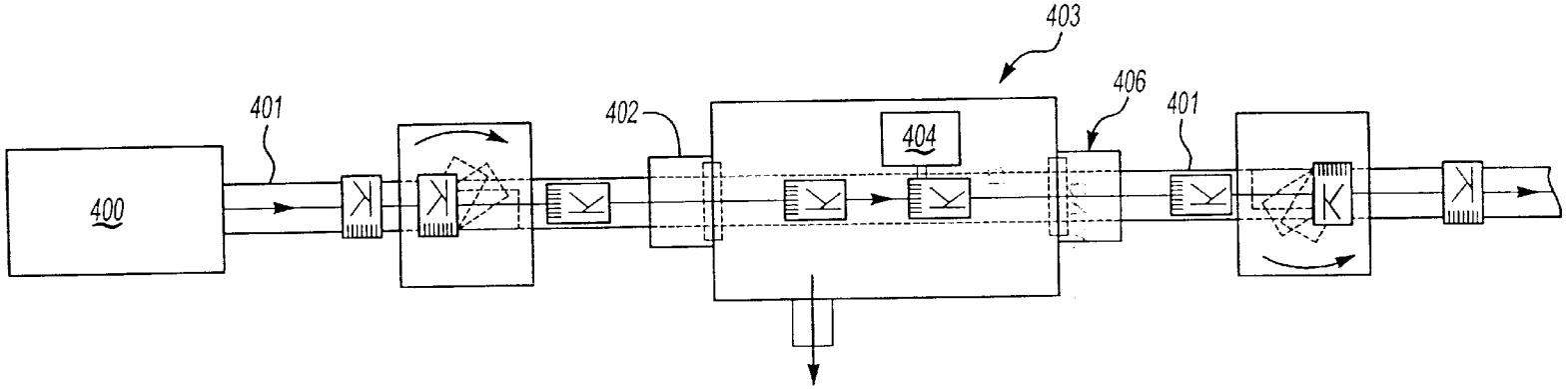
FIG. 13 is a box flow diagram of a process for sealing a liner to the pour spout assembly with the induction sealer assembly.

FIG. 13 is a flow diagram of the general process for preparing the cartons of the invention. Although further detailed in the discussion relating to FIG. 14, infra, the method begins by providing a carton blank and adding a spout to the carton blank. A positioning assembly such as a mandrel and clamping device may be used to position the spout on the carton. Carton 400 containing a filled and sealed bag is the starting point of FIG. 13. The filled bag includes some "dead space" which is internal space occupied by air rather than the desired content. The sealed carton having the sealed and filled liner disposed therein is fed to apparatus via conveyor 401 into the central heating section 403 section of the apparatus via a rotary infeed air lock 402. A vacuum source 404 is included in the central sealing section 403 to maintain the vacuum conditions of the central heating section. A sensor is operably connected to the infeed airlock and detects the cartons as they approach, and coordinates the opening and closing of the airlock with the approaching cartons. The central sealing section also includes a heat sealer 403 and vacuum source 404. The vacuum conditions cause the dead space in the sealed, filled bag to expand and press against the inner walls of the carton, and heat from the induction heating unit causes bonding of the bag to an inner wall or a pour spout of the carton. The adhesive may be applied to the outer portion of the bag or to the desired portion of the carton or pour spout, as appropriate.

Once the bag is affixed to the carton, the sealed carton is transported out of central sealing section 403 via conveyor 401 through discharge airlock 406. Discharge airlock 406 is operably connected to a sensor to approach the approach of sealed cartons in a similar manner described above with respect to the infeed airlock. The carton can then be case packed for shipping to retailers.

Figure 14A:
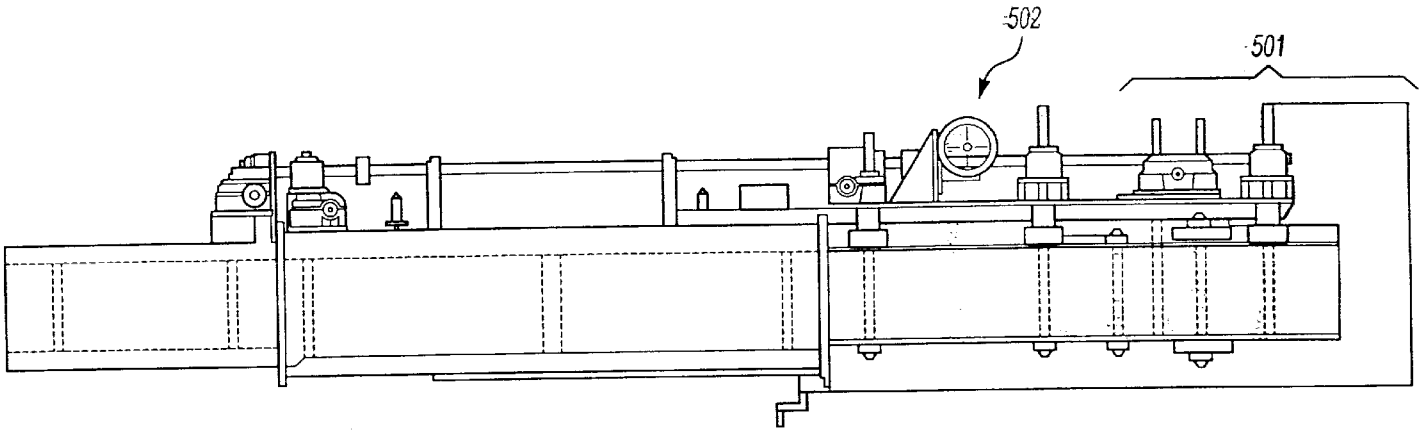
FIGS. 14*a* and 14*b* a plan and side elevation views respectively of a preferred apparatus for preparing cartons of the present invention.
Figure 14B:
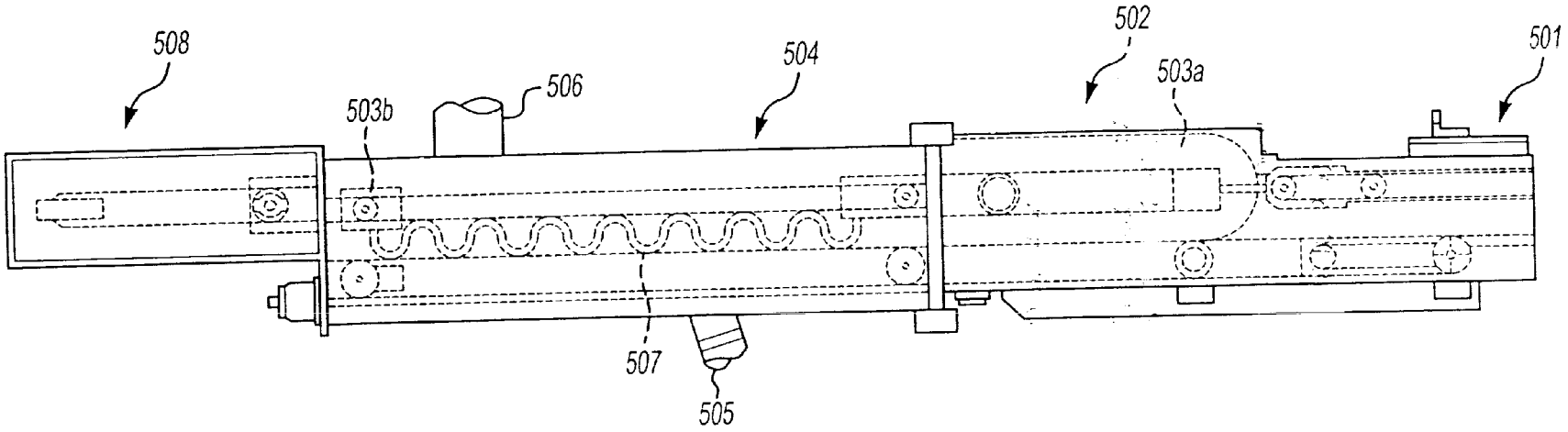

FIGS. 14*a* and 14*b* are directed to a preferred apparatus according to the invention.

FIG. 14*a* is a plain view of a preferred apparatus, according to the invention; with the process flow depicted right to left. Infeed metering roll 501 meters the sealed cartons having a filled and sealed product-containing liner (not shown) entering the apparatus via infeed rotary airlock 502. The sealed cartons are fed through the various sections of the apparatus via an endless conveyor, or, in this case, a series of conveyors 503*a, b, c,* etc. aligned to provide downstream transport relative to the process flow. Central sealing section 504 has vacuum source 505 and an induction heater 506 to heat the heat-activatible adhesive on the carton or bag and adhere the bag to the box. In this embodiment, a settler 507 is provided to settle the contents of the bag in the container. The carton resides in central sealing section 504 for a sufficient period of time to adhere the carton and bag, which is then transported via conveyor 503*b* through discharge rotary airlock 508.

At any given time, there are three cartons in the various sections of the apparatus: one in the discharge airlock section, another in the central sealing section, and a third in the infeed section. These are passed via conveyor in the direction of the process flow, as determined via a sensor system which tracks the movement and position of the cartons relative to the apparatus and also preferably to each other.

Turning to other specifics in the implementation of the system, the present invention contemplates the above process utilizing multiple adhesive systems such as hot melt (which might further employ any variety of heating methodologies, including, but not limited to conduction, convection, or by activating the sealant with electromagnetic or sonic energy, through induction heating, etc.) or cold seals such as non-heat activated adhesives or pressure sensitive adhesives.

Hot-melt adhesives are 100% solids and are applied in hot, molten form. They set fast when heat is removed and can be preapplied and reactivated later by the application of heat. Hot melt adhesives are typically formulated with a backbone polymer such as ethylene-vinyl acetate or polyethylene. The main polymer is usually let down with a diluent such as wax to improve melt flow properties. Antioxidants may be added since the adhesive is applied hot and is subject to oxidation. Tackifiers can also be added to improve hot tack and viscosity. Other materials can be added to influence the melt temperature, and colorants may be added to make the adhesive more visible.

Hot-melt adhesives are readily available from numerous sources. INSTANT LOK® hot melt adhesives from National Starch and Chemical Corporation of Bridgewater N.J. 08807 are suitable for use in the invention.

In preferred embodiments, sealing of the bag to the carton is accomplished using, e.g., sonic energy transmission (transmitted from either mandrel 410 or the clamping assembly), to activate any of the multiple adhesive systems.

In a preferred embodiment, the hot melt adhesive is heated by induction. In this embodiment, an activatable hot melt adhesive is applied between the liner and the dispensing flap or front panel, and heat is applied to the interface of the liner and the dispensing flap such as by induction heating. Activation of the hot melt adhesive can also be accomplished by inclusion of a heat generating substance in or positioned such that the hot melt adhesive to generate the beat necessary to activate the hot melt adhesive to bond the liner to the dispensing flap or frontpanel. Such heat generating substances include metal foils such as aluminum foil, which may be laminated on one or both sides to a hot melt adhesive, metal salts such as magnesium chloride, chromium nitrate, aluminum chloride and the like, which are mixed with the hot melt adhesive; and metal particles such as iron or aluminum powder mixed with or flocked onto the hot melt adhesive applied to the flap or front panel.

When using magnetic particles such as iron, a magnet can be employed to orient the particles and promote bonding with the liner, e.g., to aid in creating a tearable seam to facilitate opening of the spout. The metal salts and metal particles are used in amounts sufficient to activate the adhesive when external bonding energy is applied.

Metal foil laminates are preferred heat promoters because of their ease of application and activation. A typical metal foil laminate includes aluminum foil, generally vacuum metalized aluminum on a polyester film, with a linear low density polyethylene adhesive on one or both sides. Curwood Inc., of Oshkosh, Wis. 54903, provides CURLAM® Grade 5432 film which has an adhesive on one side of the film. It is preferred to coat both sides of the film with an adhesive which enables the use of induction heating to bond the foil laminate to the front panel and the bag at the same time.

The intensity and duration of the induction field required to bond the liner to the front panel depends on the composition of the heat activatable adhesive. For example, an aluminum foil laminated with linear, low density polyethylene generally achieves its sealing temperature in 0.9 to 1.2 seconds when exposed to a Lepel, LEPAK, Jr. 750 watt induction sealer. An adhesive having a resin base including about 5 to 10 weight percent metallic salt, such as chromium nitrate or aluminum chloride, generally reaches its sealing temperature in under 2.0 seconds when placed in an 800 watt GE microwave oven operating at 900 to 1100 kHz.

Other induction heating systems and heat activatable adhesives can be adapted to the present invention. For example, an induction heating system for sealing packages using magnetic susceptible particles and heat softenable adhesives and high frequency alternating magnetic fields is disclosed in U.S. Pat. No. 3,879,247 which is incorporated herein by reference. Polymer systems for sealing containers which can be activated by electromagnetic energy frequencies of 0.1–30,000 MHZ, including radio frequency and microwave heating, are disclosed in U.S. Pat. 4,787,194 which is incorporated herein by reference. RF sealable, non-foil acrylate based polymers for packaging applications are disclosed in U.S. Pat. No. 4,660,354 (Example 1) and WO 95/03939 which are also incorporated herein by reference.

Heat sealing the liner to a flap or the front panel of the pour spout preferably locally weakens the liner to facilitate separation of a portion of the liner upon initial opening of the pour spout or flap. In one embodiment, this can be accomplished by attaching a metal foil laminate to the front panel of the pour spout or to the fitment which defines the dispensing opening. The foil can be configured so as to concentrate heat at the edges of the dispensing opening which crates a weakened or thinned tear line without breaking the seal of the bag.

A preferred liner is biaxially oriented, laminated high density polyethylene film. Such films will tear easily in the longitudinal or machine direction and to impart better tearability in the transverse direction, fillers such as finely divided calcium carbonate, silica, diatomaceous earth and the like can be added to the film. A suitable film can have two high density polyethylene layers containing 15% by weight finely divided silica in the inner layer and 10% in the outer layer.

In another embodiment, a fitment defining a dispensing opening, preferably with a cut-out piece, is positioned by a positioning assembly between the liner and the front panel of a pour spout. Positioning of the fitment may be accomplished, through a variety of systems which position the fitment between the liner and the carton, and will ideally be affixed to the carton with a hot melt adhesive. Positioning the fitment in this manner defines a focused seal area around the periphery of the dispensing opening and provides a weakened seal line which facilitates separation from the liner.

Other methods of scoring a liner include applying a metal containing substance, such as a metal foil or a metal ink, directly to the liner, and then exposing the liner to an induction field.

Figure 4:
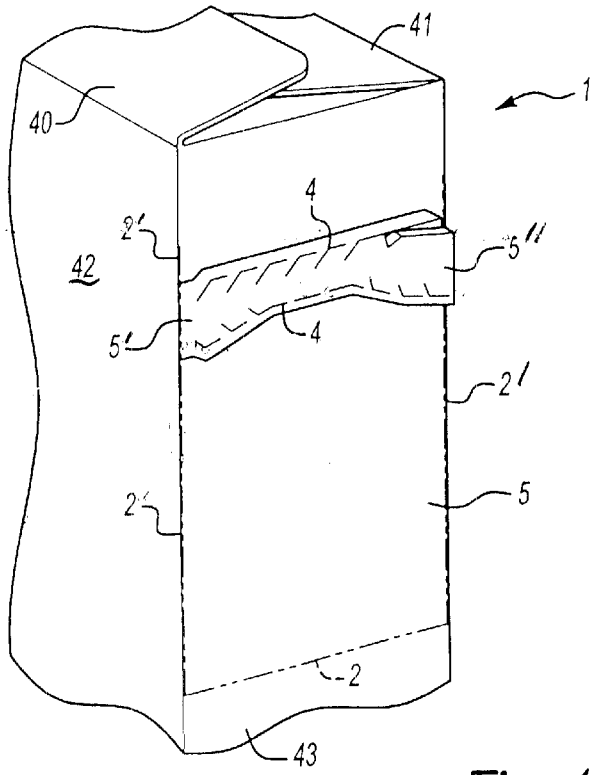
FIG. 4 is a perspective view of a carton with access to a dispensing assembly of the invention.
Figure 5:
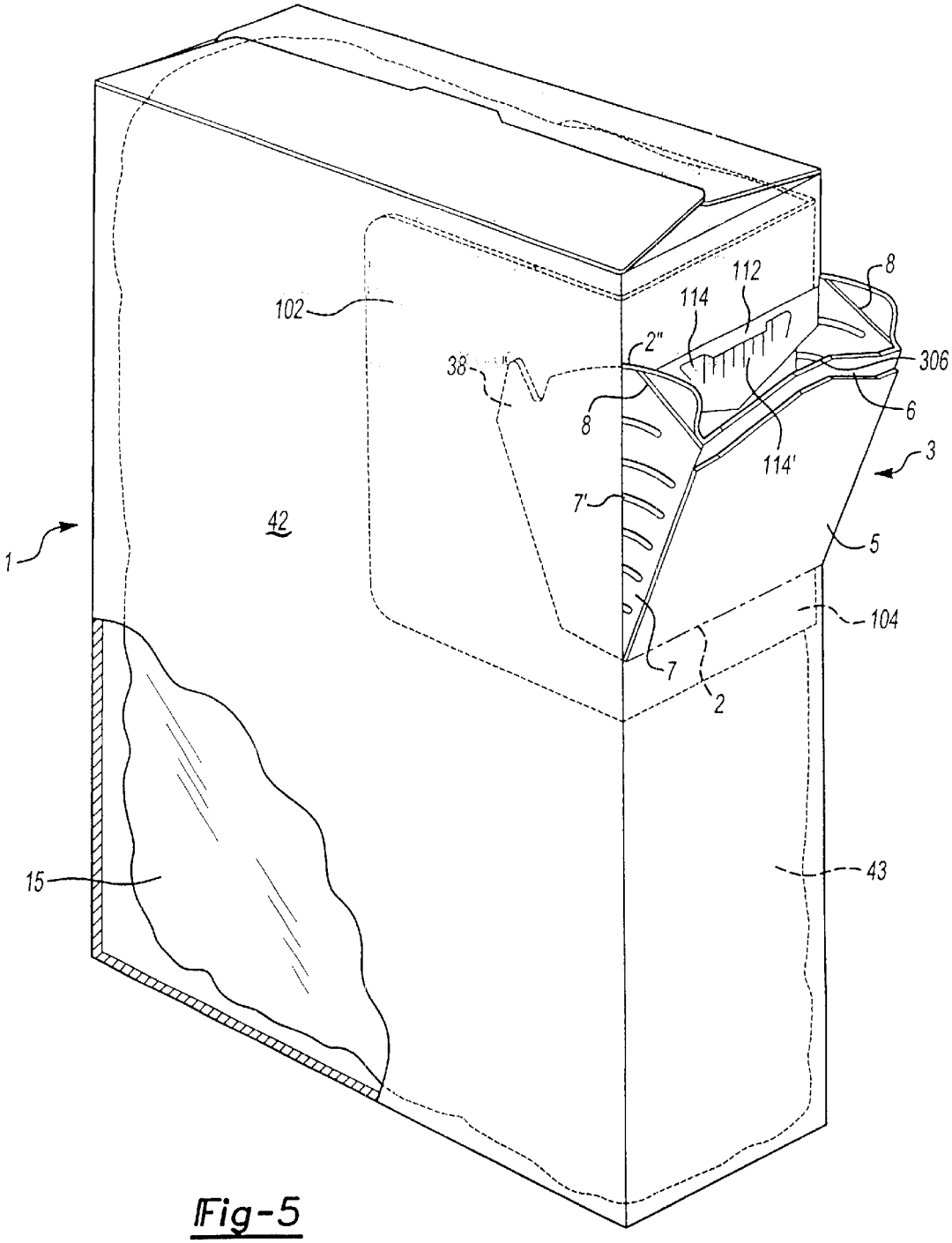
FIGS. 5 and 6 are perspective views of a dispensing assembly of the invention partly open and fully open.
Figure 6:
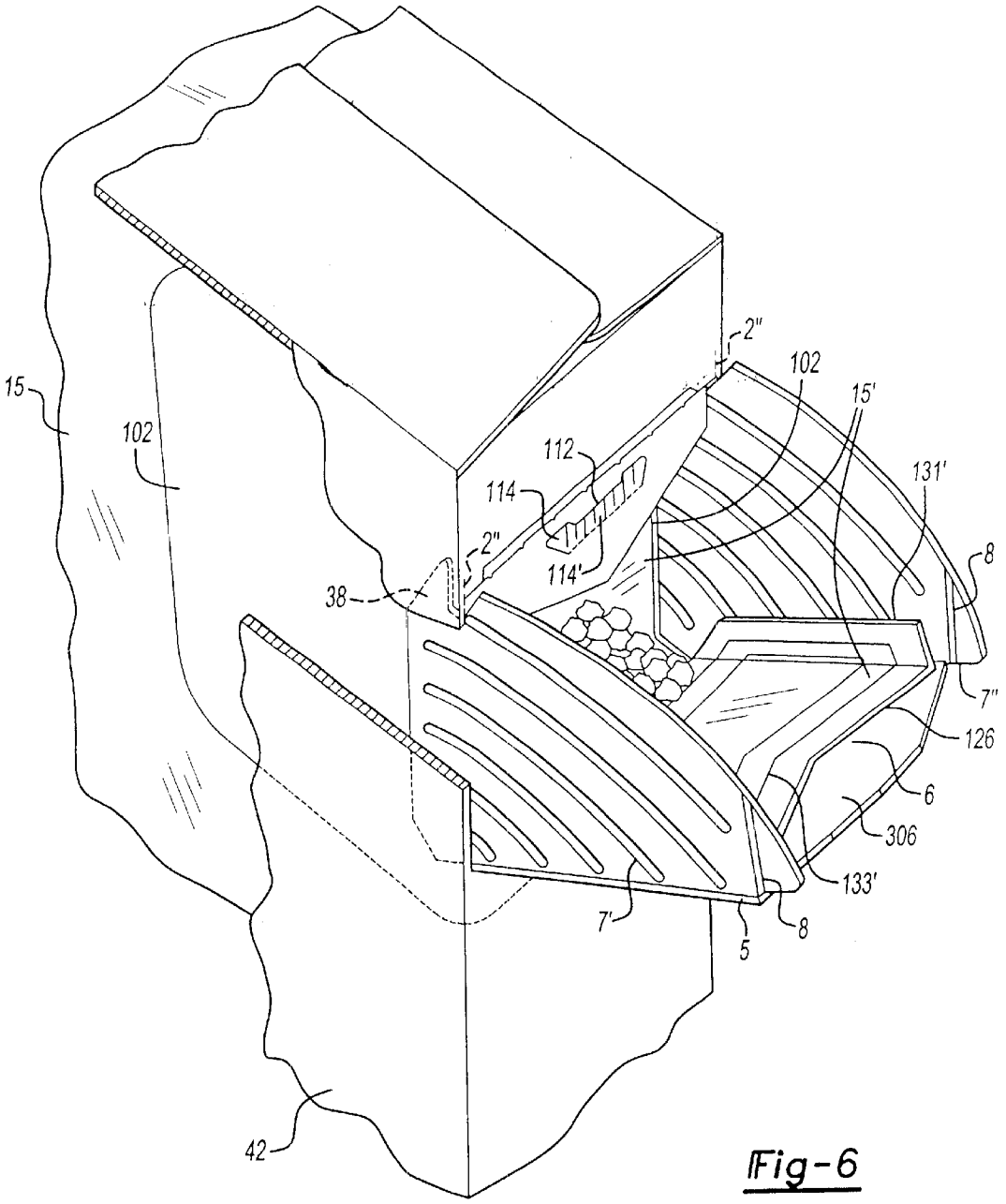

Referring now to FIGS. 4–6 of the drawing, the dispensing assembly of the invention, shown generally by reference numeral 3, is mounted to a dispensing opening in carton 1. Carton 1 includes side walls 42, end walls 43 and top flaps 40 and 41. The carton bottom is defined by similar flaps which are folded over and adhered to each other (not shown).

A sealed plastic liner bag 15 with particulate product such as RTE cereal is in carton 1. Access panel 5, which is perforated on three sides from end wall 43 so as to pivot around axis 2, carries the pour spout which includes front panel 6 and side panels 7 (FIG. 3).

Access to pour spout 3 can be gained by removing strip 5 between perforated lines 4 via pull tab 5" thus exposing an upper portion of front panel 6 (FIGS. 4 and 5). Alternatively, panel 5 can abut a cut line in end wall 43 which can be covered by a peel off tape which can be removed for initial opening of the pour spout 3. Resealable peel-off tape can cover panel 5 and the surrounding areas to insure freshness.

Figure 1A:
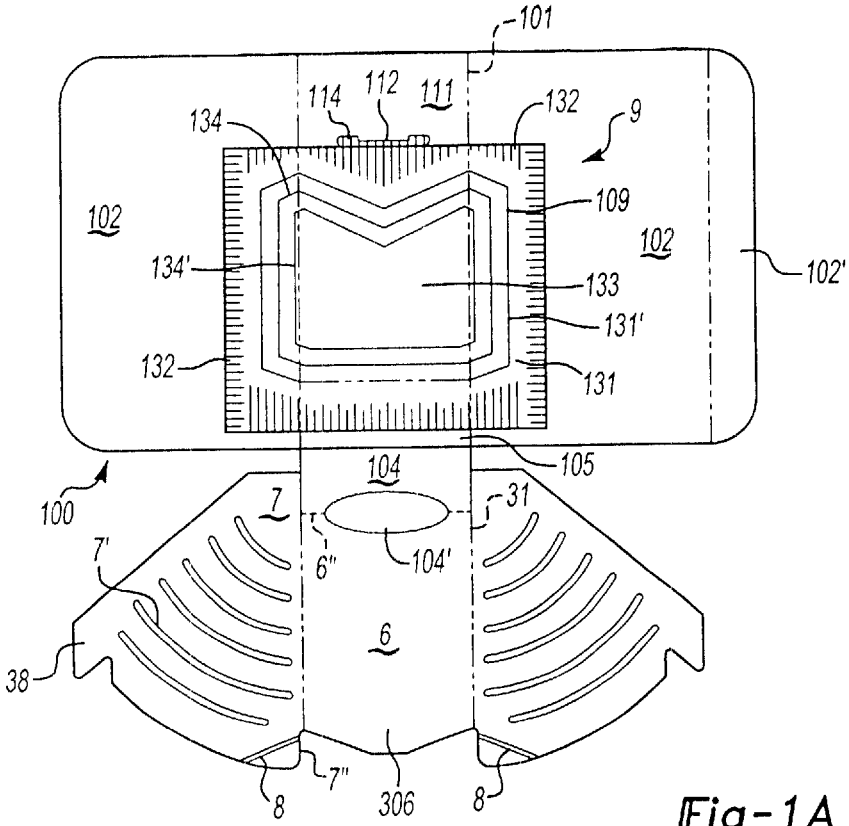
FIG. 1A is a plan view of a pour spout of the invention opened up and laid flat.
Figure 1B:
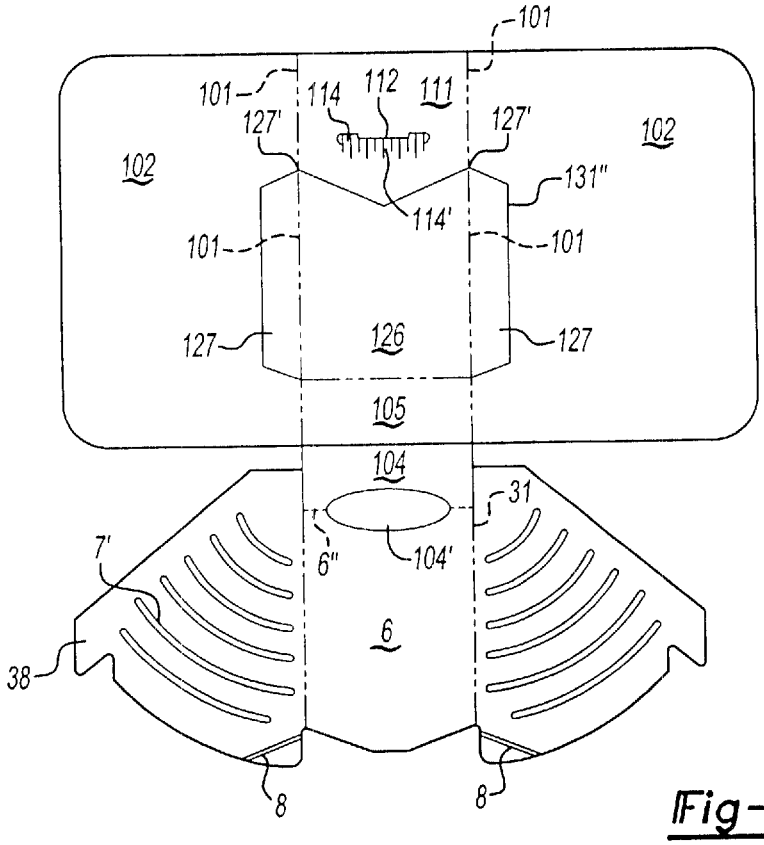
FIG. 1B is a plan view of the other side of the pour spout of FIG. 1A.
Figure 2:
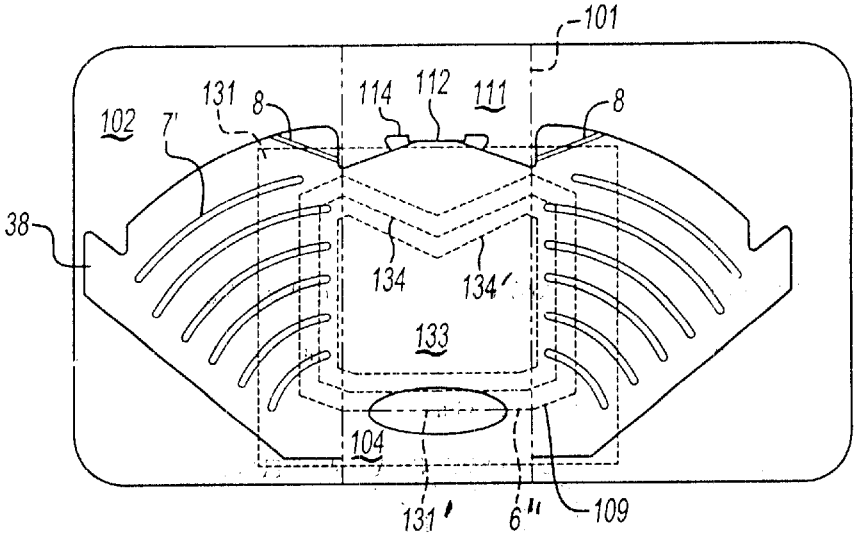
FIG. 2 is a plan view of the assembly of FIG. 1B turned over with the pour spout folded over a fitment which defines a dispensing opening shown in phantom.
Figure 3:
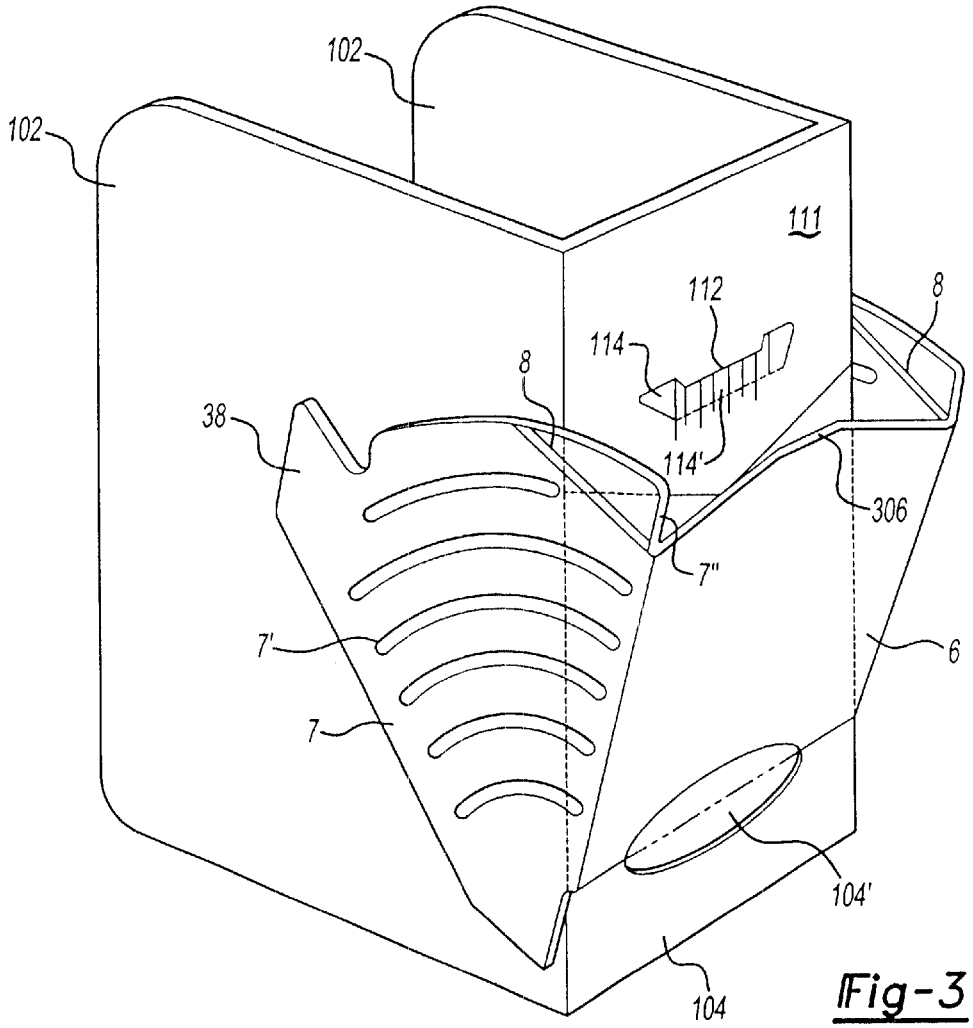
FIG. 3 is a perspective view of the pour spout assembly of FIG. 2 shown folded and partly open.

In the embodiment shown in FIGS. 1–3, the pour spout assembly has side panels 7 joined to front panel 6 along fold lines 31. Side panels 7 have stepped portions 7" and ears 38 which interact with end wall 43 and cuts 2" to define the open and closed positions of the pour spout. Side panels 7 have curved embossed areas 7' to stiffen or reinforce the panels 7 for closing the pour spout and diagonal embossed lines 8 to allow the stepped portions 7" to flex if necessary to fit between side wall 42 and end wall 43 at 2".

Front panel 6 in integral with fitment 100 via panel 104. Fitment 100 has upper and lower margin portions 111 and 105, respectively, side members 102 and a cut-out piece having a central section 126 and vertical side pieces 127 which extend into side members 102 (FIG. 1B) to define dispensing opening 109 along line 131' as shown in dotted lines under bonding member 9 (FIG. 2).

Front panel 6 has a tab 306 which releasably interlocks with tab 112 and panel 114 having slits 114' of upper margin portion 111 when spout panel 6 is folded over fitment 100 (FIG. 2).

In one embodiment, upper margin portion 111 can have laterally extending flexible tabs (now shown) that interact with stepped portions 7" and cut-outs adjacent ears 38 (not shown) to hold the spout in the open and closed positions. Ears 38 prevent pull-out of the spout. Stepped portions 7" slide through cuts 2" in end wall 43.

When the pour spout is folded over fitment 100 (FIG. 2), connecting panel 104 ties on top of lower margin portion 105 and frontpanel 6 covers central section 126 of cut-out 126/127 and pivots at line 6" which is aligned with the bottom of opening 109. Oval cut-out 104' along line 6" facilitates flexing and bending of the pour spout. Side members 127 are folded at right angles to panel 6 and cut-out 126/127 fits into dispensing opening 109 defined by fitment 100 when the pour spout is closed.

The pour spout and fitment can be spot glued or otherwise affixed to the interior of carton end wall 43 via upper portion 111 and lower portion 105. One side member 102 can be wider to provide an area 102" (FIGS. 1A and B) to spot or hard glue to the interior of carton side 42 before the carton is erected. This insures that side members 102 will stay flat against the interior side walls of the carton when erected so as not to interfere with the insertion of a filled and sealed bag.

The top of opening 109 is V-shaped and the upper corners provide areas of reduced resistance to initiate separation of the liner bonded to cut-out 126/127 from liner 15 itself.

Figure 8A:
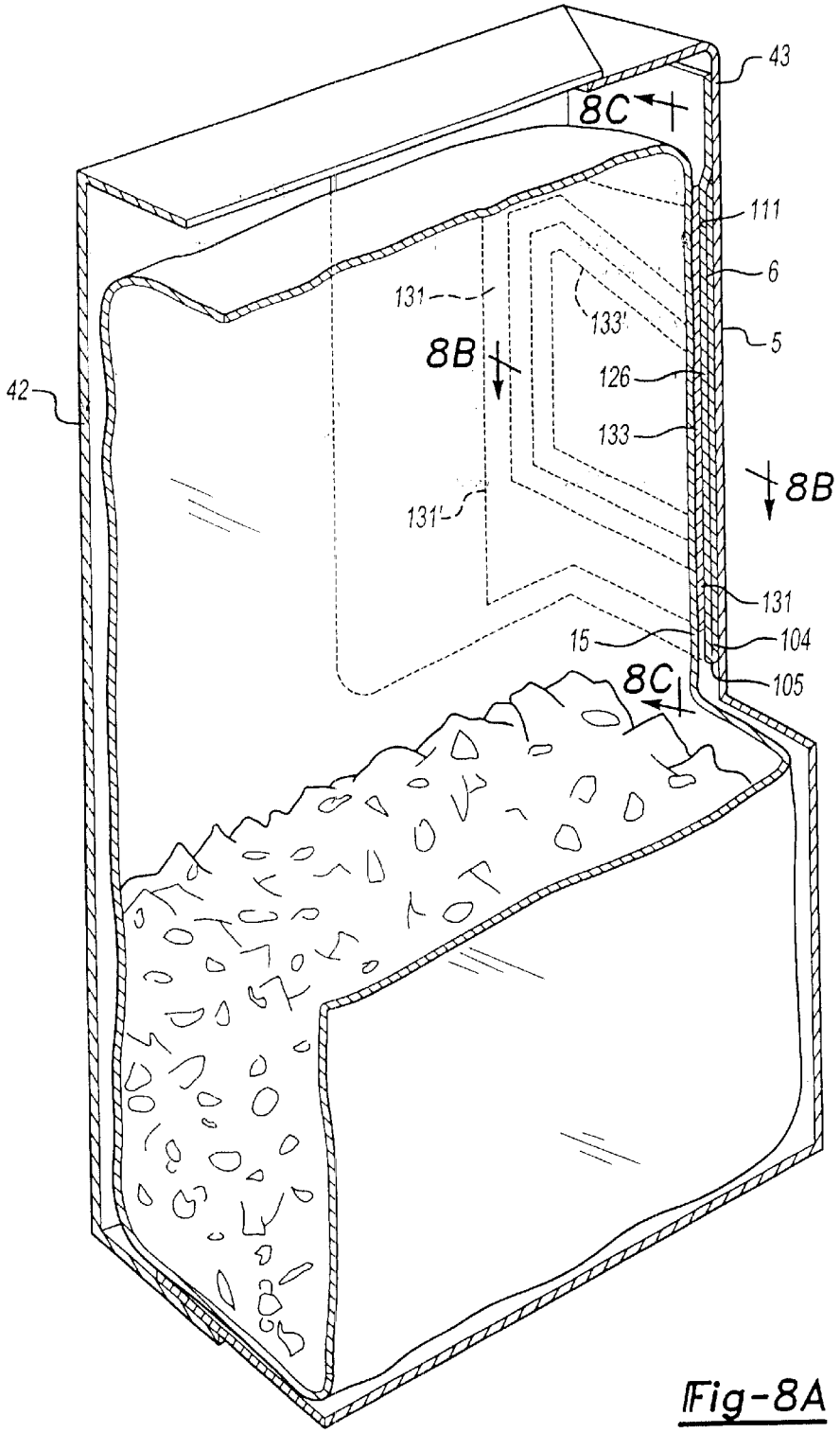
FIG. 8A is a perspective view, broken away, of the interior of a dispensing assembly of the invention.
Figure 8B:
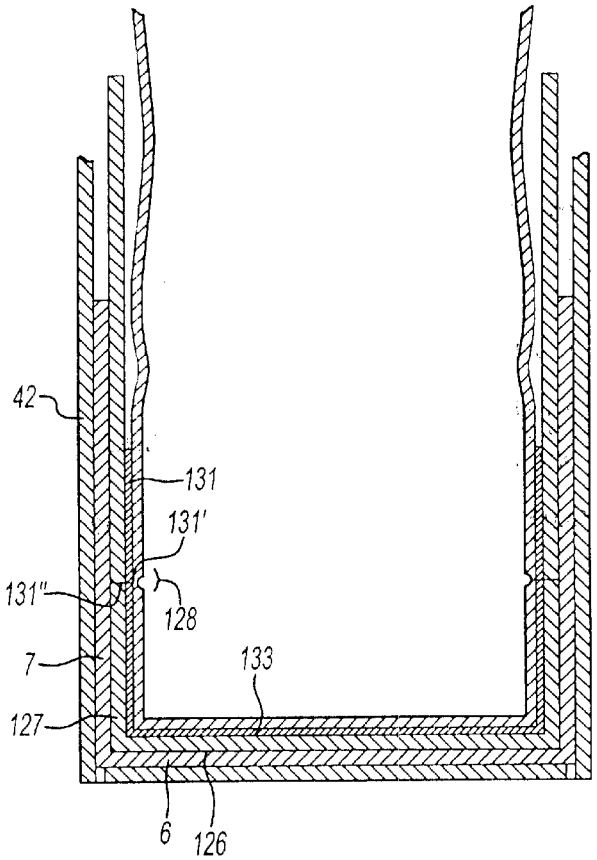
FIGS. 8B and 8C are cross-sectioned views taken along lines 8B—8B and 8C—8C of FIG. 8A.
Figure 8C:
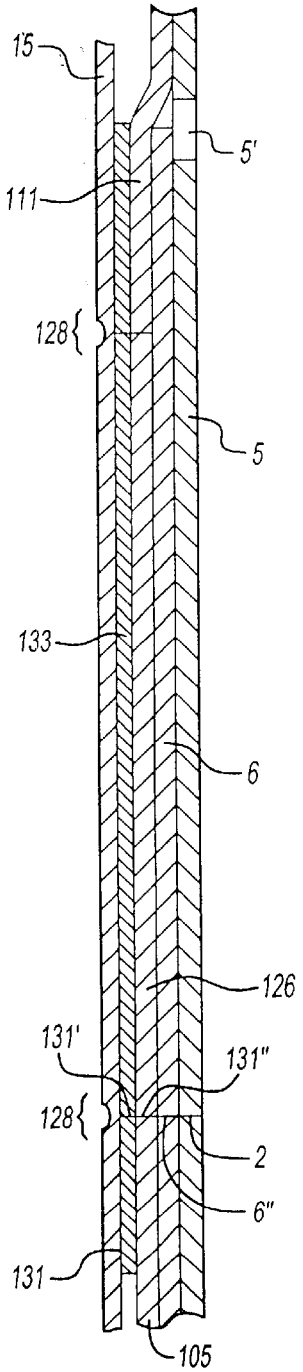
Figure 8D:
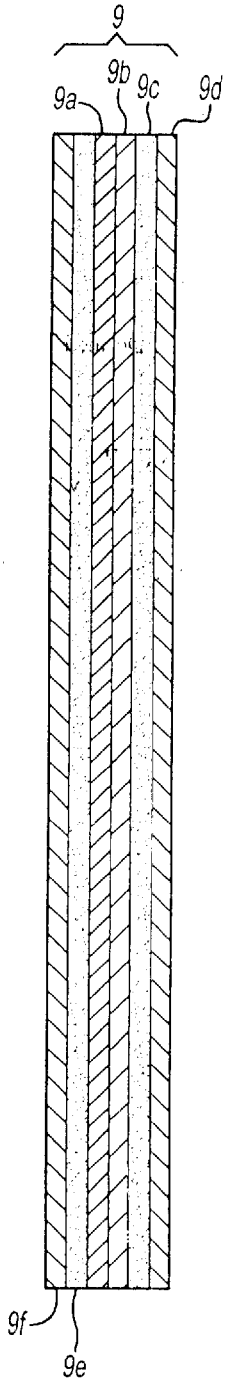
FIG. 8D is a cross-sectional view of laminated foil used to promote bonding.
Figure 9:
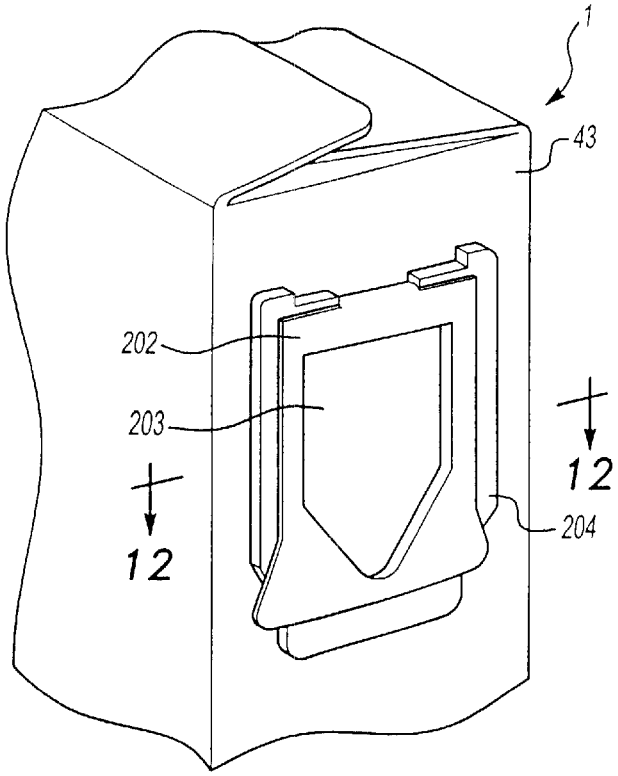
FIGS. 9 and 10 are perspective views of an alternate dispensing assembly show closed and open.
Figure 10:
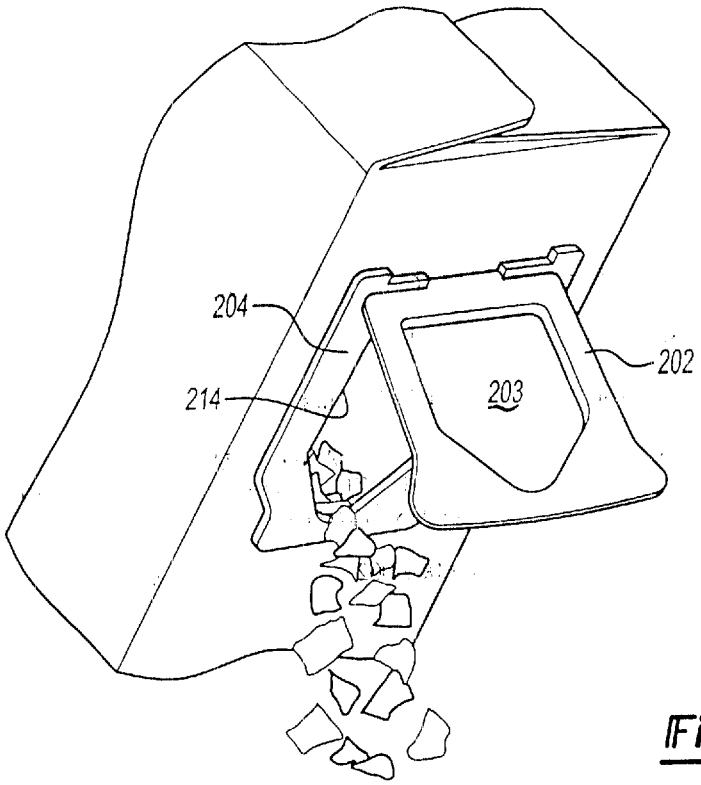
Figure 11:
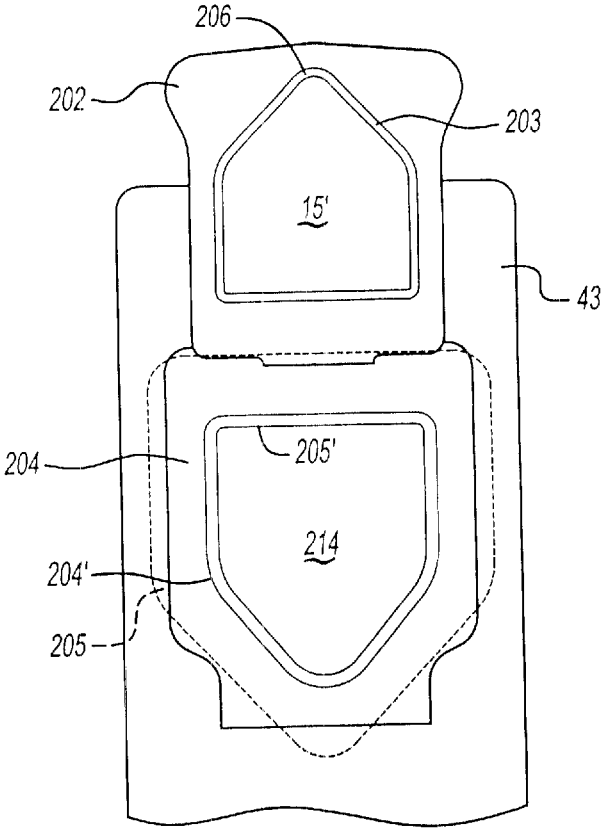
FIG. 11 is a front view of the assembly of FIGS. 9 and 10 shown fully open.
Figure 12:
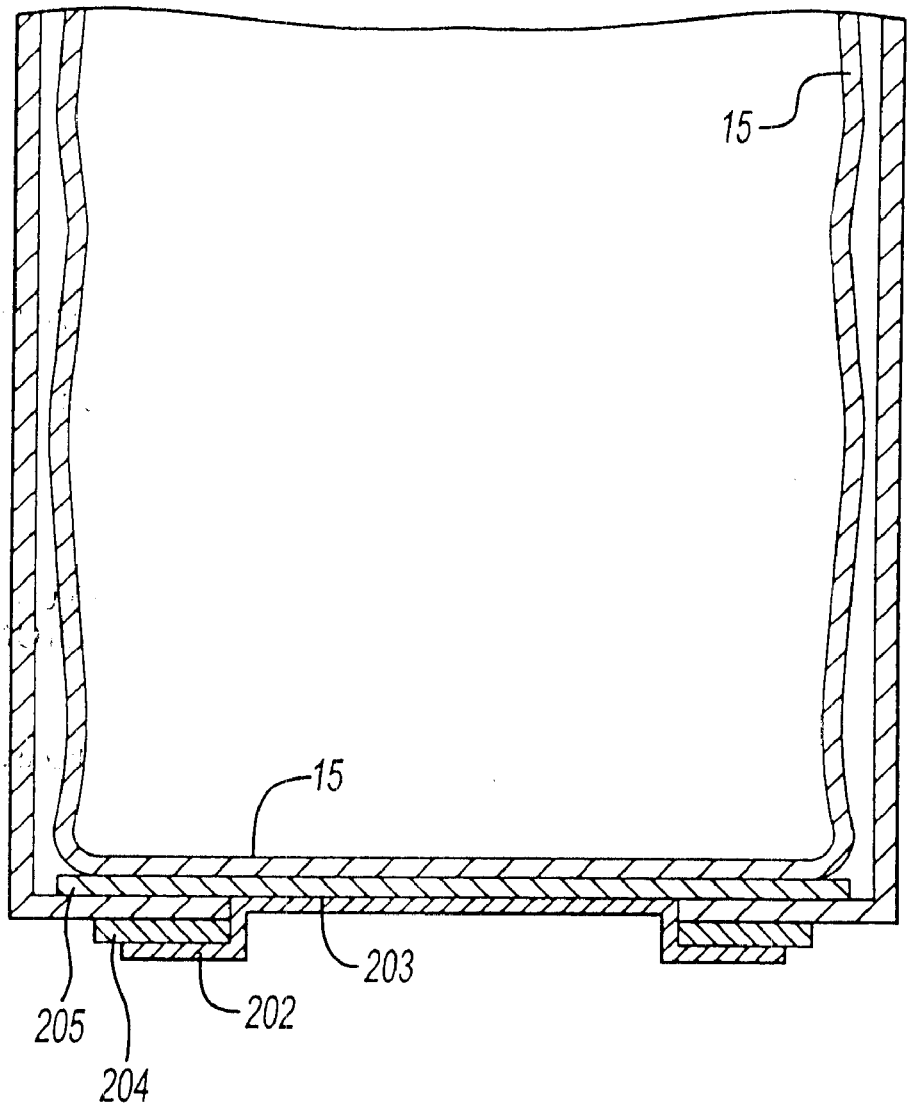
FIG. 12 is a cross-sectional view taken along line 12—12 of FIG. 9.

A preferred bonding member 9 (FIGS. 1A and 2) is a metal foil laminate having an outer member 131 and an inner member 133. As shown in FIG. 8D, a preferred member 9 includes a layer of metal foil 9*a* such as aluminum foil or vacuum metalized aluminum adhered to polyester layer 9*b*. Adhesive layers 9*c* and 9*e* flank both sides of the polyester/foil laminate. Linear low density polyethylene adhesive layers define the outermost layers 9*d* and 9*f*. The overall thickness of member 9 is about 5 mils.

Bonding member 9 can be adhered to fitment 100 in a number of ways. It can be fully glued in place using a pressure sensitive, heat activated or other adhesive. It can also be spot glued for later full gluing by actuating adhesive layer 9*d* or 9*f* at the same time the other layer is bonded to liner 15.

Margin portions 111 and 105 and side members 102 surround opening 109. Inner member 133 corresponds to opening 109 and is connected to outer member 131 via perforation line 131' about the periphery of opening 109.

Inner member 133 has score lines 134 and 134' in the shape of inner member 133 to concentrate heat for bonding around the periphery of line 131'. This creates a weakened seal line in the area of line 131' to facilitate initial opening of the pour spout, especially at the upper corners of opening 109 where cut-out members 126 and 127 meet along fold line 101.

Figure 7:
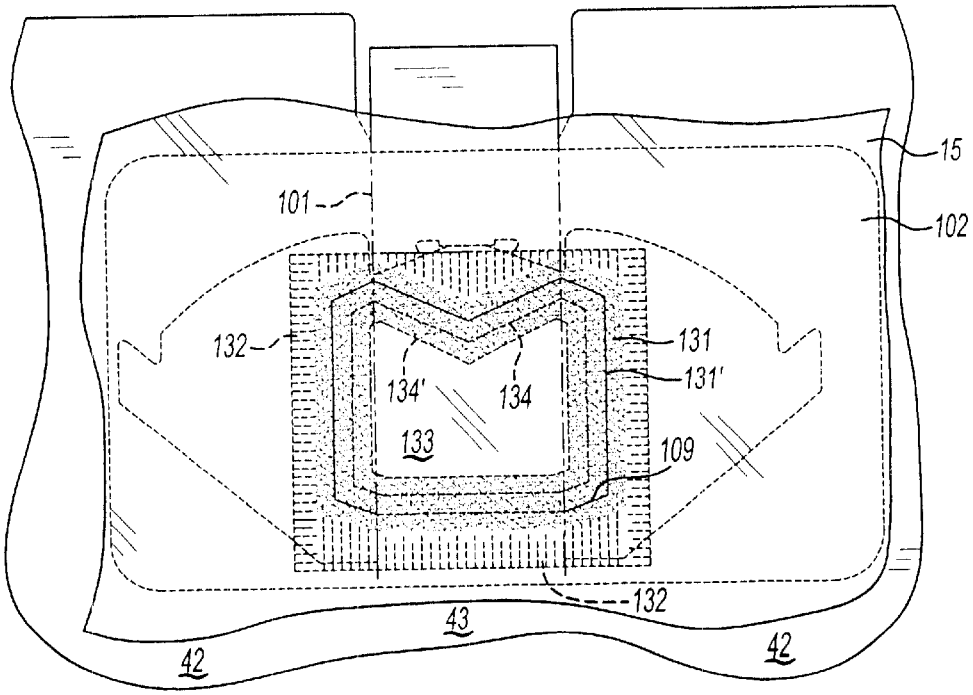
FIG. 7 is a plan view showing the assembly of FIG. 1A with the pour spout folded under a fitment (FIG. 2 turned over) and positioned on the interior of a flat carton blank.

Outer member 131 has a series of graduated fingers or cuts 132 which help to distribute bonding heat over the area of member 131 and away from the outer edges to prevent the formation of weak spots when liner 15 is bonded to the area surrounding opening 109 to maintain alignment of the liner with the pour spout. Fingers 132 also cooperate with score lines 134 and 134' to concentrate bonding heat along line 131' to form a thinner or weakened tear line in liner 15. In the embodiment shown in FIG. 7, liner 15 is bonded to outer member 131 in an area between fingers 132 and line 131' and to inner member 133 in the areas defined by line 131' and score lines 134 and 134'.

Heat delivered via induction heater 21 heats inner and outer members 131 and 133 which in turn activates adhesive layers corresponding to layers 9*d* and 9*f* of FIG. 8D. Adhesive layer 9*d* adheres member 9 to cut-out 126/127, side members 102 and margin portions 105 and 111. See FIGS. 1A and B. Because heat generated by foil layer 9*a* becomes concentrated as shown and described in FIG. 7, a thinning of liner 15 occurs at 128 (FIGS. 8B and C) around the edges of cut-out 126/127 to facilitate initial opening of the pour spout. While liner 15 is thinned along line 131', the seal of the bag is not broken until the pout spout is opened by the consumer.

To open the pour spout of FIGS. 1–7, tab 5" is pulled to remove section 5'. This exposes tab 306 of front panel 6 which extends above access panel 5. Insertion of one or more fingers behind tab 306 will cause the liner to begin to tear at the upper corners of center section 126 where they join side sections 127 along fold line 101. Continued pulling separates panel 5 along lines 2' and the liner along line 131' until it reaches the bottom corners of center section 126 when the spout is fully open. Liner 15 remains connected to outer member 131 where it is attached to side members 102 and margin portions 105 and 111.

In the embodiment shown, spout side panels 7 pivot in and out between a narrow space defined by side members 102 and carton side walls 42 without coming into contact with liner 15.

Upon closing of the spout, cut-out 126/127 fits neatly back into dispensing opening 109 defined by side members 102 and margin portions 105 and 111 of fitment 100 to minimize invasion of exterior air. When closed, recess 7" of the side panels slip behind cuts 2" to maintain closure of the spout. For added holding power, tab 306 interlocks with members 112 and 114 providing a "snap" closure to insure freshness.

FIGS. 9–12 show an alternate embodiment wherein pour door 202 with a recessed center section 203 snaps into frame 204 which is mounted to a dispensing opening 214 in end wall 43 of carton 1.

Metal foil laminate 205 (similar to member 9) is perforated along line 205' and is adhered to the interior of end wall 43 over opening 214.

Liner 15 is adhered via laminate 205 to the interior end wall 43 surrounding opening 214 and to recessed portion 203 of door 202. When pour door 202 is lifted up the first time, portion 15' separates from liner 15 along line 205' providing access to the contents thereof. Initial separation of portion 15' takes place where opening 214 is pointed (at 206) which offers less resistance than trying to tear an entire side at one time.

Liner 15 and its contents remain aligned with opening 214 because the liner 15 is adhered via member 205 to end wall 43 around opening 214.

The process of the present invention may be used to adhere a filled bag to a carton using the adhesives described above. For example, traditional bag in the box packages without pour spouts can be prepared with adhesive areas along the inside walls of the carton to prevent the bag from settling down inside the box.

We claim:

1. Apparatus for adhering a filled and sealed liner to the interior of a dispensing assembly located in an end wall of a carton without breaking the seal of said filled liner, comprising:

a central sealing section connected to a vacuum source and having means for sealing positioned therein to align with said end wall of the carton;

an infeed airlock and a discharge airlock in communication with the central sealing section;

a conveyor for moving said sealed cartons from said infeed airlock through said central section in sealing contact with said end wall and into said discharge airlock while maintaining a vacuum atmosphere in said central section;

whereby said liner is sealed to the interior of said dispensing assembly without breaking the seal of said liner.

2. Apparatus of claim 1, whereby said liner is sealed along a weakened tear line to the interior of said dispensing assembly.

3. Apparatus of claim 1, further comprising lateral conveyors at right angles to said conveyor positioned to provide a snug fit with a carton.

* * * * *